US006232383B1

(12) United States Patent
Joseph

(10) Patent No.: US 6,232,383 B1
(45) Date of Patent: May 15, 2001

(54) NUCLEAR RESISTANCE CELL AND METHODS FOR MAKING SAME

(75) Inventor: Adrian Joseph, Irvine, CA (US)

(73) Assignee: Nurescell, Inc., Irvine, CA (US)

( * ) Notice: Subject to any disclaimer, the term of this patent is extended or adjusted under 35 U.S.C. 154(b) by 0 days.

(21) Appl. No.: 09/187,641

(22) Filed: Nov. 6, 1998

(51) Int. Cl.[7] ..... G21C 11/00

(52) U.S. Cl. ..... 524/400; 250/515.1; 250/518.1; 523/136

(58) Field of Search ..... 524/400; 523/136; 250/515.1, 518.1

(56) References Cited

U.S. PATENT DOCUMENTS

| | | | | |
|---|---|---|---|---|
| 4,209,420 | | 6/1980 | Larker . | |
| 4,547,310 | * | 10/1985 | Kasanami | 252/511 |
| 4,555,461 | * | 11/1985 | Shiba | 430/49 |
| 4,642,204 | | 2/1987 | Burström et al. . | |
| 4,759,879 | | 7/1988 | Cadoff et al. . | |
| 4,834,917 | | 5/1989 | Ramm et al. . | |
| 4,847,008 | | 7/1989 | Boatner et al. . | |
| 4,893,404 | * | 1/1990 | Shirahata | 29/852 |
| 4,992,481 | * | 2/1991 | Bonin | 521/54 |
| 5,017,967 | * | 5/1991 | Koga | 355/261 |
| 5,035,723 | * | 7/1991 | Kalinowski | 51/309 |
| 5,302,565 | | 4/1994 | Crowe . | |
| 5,556,898 | | 9/1996 | Hutton et al. . | |
| 5,683,757 | | 11/1997 | Iskanderova et al. . | |
| 5,789,071 | | 8/1998 | Sproul et al. . | |
| 5,888,627 | * | 3/1999 | Nakatani | 428/209 |

* cited by examiner

*Primary Examiner*—Paul R. Michl
(74) *Attorney, Agent, or Firm*—Hogan & Hartson, L.L.P.

(57) ABSTRACT

The present invention is a shielding material that resists both nuclear radiation and high temperatures and is especially suited to encasing radioactive waster materials to immobilize them. The material is a mixture comprised of two or more organic polymers in which included fillers are cross-linked within the phenylic side chains of the polymers and copolymers. Other fillers provide radioactive shielding and may be merely included within the cross-linked matrix. The material contains a tough matrix with embedded particles of radiation shielding substances and thermoconductive materials with an overall ceramic-like or ceramometallic properties. The material is thermosetting and can present an extremely hard material—e.g., 20,000 p.s.i. shear strength. The material is comprised of a mixture of vulcanized rubber and/or rubber-like polymers, various radiation shielding inclusions, polyimide resin and phenolformaldehyde resin. After being mixed in the proper proportions the material sets up at an elevated temperature (e.g., 260° C.). The final material has a density of between 8 and 50 pounds per cubic foot depending on the proportion and identity of the radiation resistant inclusions.

8 Claims, 2 Drawing Sheets

NRC GENERAL STRUCTURE

NUCLEAR RESISTANCE CELL AND METHODS FOR MAKING SAME

BACKGROUND OF THE INVENTION

1. Field of the Invention

The present invention concerns the field of material and compositions to shield and contain radioactive substances and radioactive substances in particular.

2. Background of the Invention

For some years, especially following the near "melt down" of the Chernobyl Power Station reactor, there has been considerable international antipathy or downright hostility towards nuclear energy. This is despite the demonstrated and growing danger of global climate change resulting from the atmospheric effects of burning fossil fuels. The primary opposition to nuclear energy stems from the seemingly insurmountable hazards and environmental damage resulting from the long-lived radioactive wastes produced by current nuclear reactors. Yet the potential environmental damage of nuclear wastes must be some how balanced against the certain environmental damage of continued use of fossil fuels.

It appears clear that the only way to avoid the environmental catastrophe posed by global warming—short of returning to a preindustrial economy—is to replace conventional power sources with ones based on nuclear fission. At some future date "dirty" fission-based power sources may be replaced with cleaner fusion-based systems, but at this time nuclear fission seems to only option. Because we do not currently know of any way to eliminate nuclear waste, our goal must be the safe handling and containment of this waste. The current nuclear fuel cycle presents a number of operations that are potentially environmentally adverse. These include the mining and manufacture of nuclear fuels, the fission of these fuels and the hazards presented by operating reactors, the on site storage of spent fuel, the transport and recycling or disposal of these fuels.

It appears that safe reactors are within the grasp of human engineering. The real environmental problem is posed by the recycling and disposal of the spent nuclear fuels. Whether the spent fuels are reprocessed to yield additional fissionable material (the most efficient alternative from the view of long term energy needs) or whether the spent fuel is simply disposed of directly, there is a considerable volume of highly radioactive substances that must be isolated from the environment. The presently acceptable approach is the internment of the radioactive material in deep geologic formations where they can decay to a harmless level without any human intervention. Ideally these "buried" wastes must remain environmentally isolated with no monitoring or human supervision. Otherwise any disruption of human civilization might lead to a catastrophic escape of radioactive materials. That is, one does not simply dump the wastes in a hole. These materials are constantly generating heat; further potentially explosive gases, primarily hydrogen, are also generated. The emitted radiation alters and weakens most materials. Presently the best approach is to reduce the wastes to eliminate solvents. The reduced wastes are then vitrified or otherwise converted into a stable form to prevent environmental migration. Nevertheless, there remains the important task of producing special materials that display unusual resistance to radiation, heat and chemical conditions that generally accompany radioactive wastes. Ideally, such materials have radiation shielding properties and can be used to shield and incase otherwise reduced wastes. Another important application of such materials is the sealing of decommissioned or damaged nuclear facilities.

The simplest and crudest of such materials is probably concrete. Because of the mineral inclusions in simple portland cement based materials or similar materials to which additional shielding materials (e.g. heavy metal particles) these substances provide shielding of nuclear radiation. However, simple concrete may not long survive under the severe chemical conditions provided by some nuclear wastes. Concrete tanks of liquid nuclear wastes have useful lifetimes of less than fifty years. Concrete is more effective against reduced vitrified wastes but is still far from ideal. There have also been a number of experiments with novel shielding-containment materials that would be easier to apply and have superior shielding and/or physical properties. However, until now these materials have not proven widely successful.

SUMMARY OF THE INVENTION

The present invention is a shielding material that resists both nuclear radiation and high temperatures and is especially suited to encasing radioactive waster materials to immobilize them. The material is a mixture comprised of two or more organic polymers in which included fillers are cross-linked within the phenylic side chains of the polymers and copolymers. Other fillers provide radioactive shielding and may be merely included within the cross-linked matrix. The material contains a tough matrix with embedded particles of radiation shielding substances and thermoconductive materials with an overall ceramic-like or ceramometallic properties. The material is thermosetting and can present an extremely hard material—e.g., 20,000 p.s.i. shear strength. The material is comprised of a mixture of vulcanized rubber and/or rubber-like polymers, various radiation shielding inclusions, polyimide resin and phenolformaldehyde resin. After being mixed in the proper proportions the material sets up at an elevated temperature (260° C.). The final material has a density of between 8 and 50 pounds per cubic foot depending on the proportion and identity of the radiation resistant inclusions.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
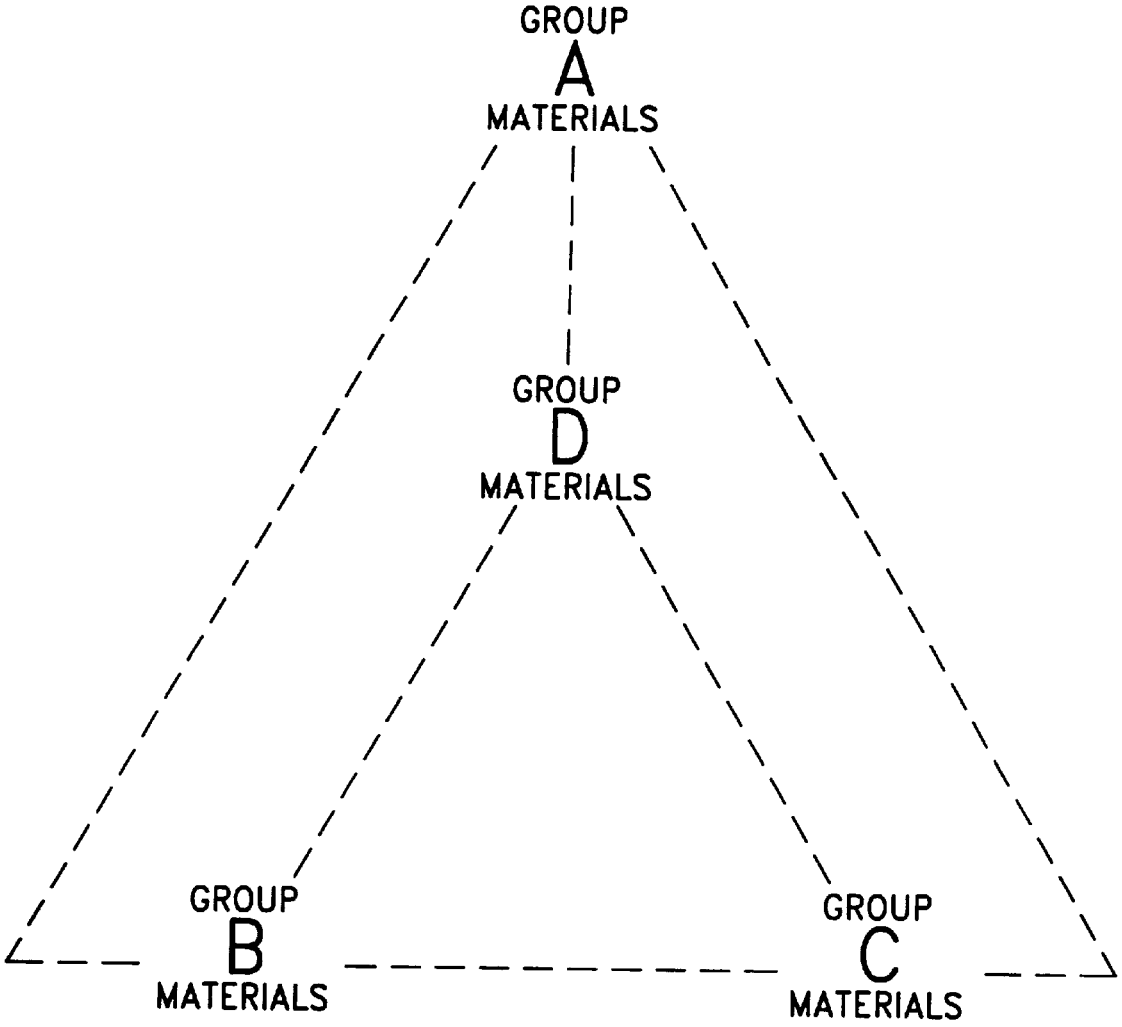
FIG. 1 represents a diagrammatic representation of the structure of the nuclear resistance material of the present invention.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a nuclear shielding material that is easy to apply and resists a variety of chemical and physical challenges.

The present invention provides a novel material for shielding and internment of radioactive wastes that has superior shielding and physical properties to concrete. The material is non-cellular in that it contains a tough matrix with embedded particles of radiation shielding substances and thermoconductive surfaces with ceramic-like properties. This pseudo-ceramic or ceramometallic structure reduces the overall weight of the material while actually adding to its favorable physical properties. Because the material is intended to provide nuclear resistance it is herein referred to as NRC (Nuclear Resistance Cellular material).

NRC is comprised of two or more organic polymers in which included fillers are cross-linked within the phenylic side chains of the polymers and copolymers. Other fillers provide radioactive shielding and may be merely included within the cross-linked matrix. NRC is thermosetting and once fully polymerized can present an extremely hard (approximately Rockwell $R_c$92—20,000 p.s.i. shear strength) material that is impervious to a wide range of chemical agents. Prolonged exposure to very high temperature (2,200° C.) may ultimately result in decomposition of the organic matrix. However, the various fillers and inclusions then form a ceramic-like matrix so that the overall properties of the NRC remain relatively constant. That is, its shielding ability is not significantly affected and the ceramometallic structure maintains significant physical strength even when exposed to very high temperatures.

NRC is produced by mixing and heating approximately equal amounts by weight of Compound 1 with Compound 2. Each of the compounds contains a portion of the cross-linking and shielding system of the final material. The basic thermosetting resin system employed comprises vulcanized chlorinated rubber (caoutchouc), polyimide resin and phenolformaldehyde. Various radiation shielding and other materials are included to impart strength and favorable radiation properties. The inventor conceives of these various ingredients as representing four different Component Group materials denoted by the letters "A," "B," "C," and "D." There are a number of alternative ingredients in each Component Group as explained below. Compound 1 is composed of Component Group materials A and C wherein the Component Group C materials are preferably present at between 7.5 and 17.5% by weight of the Component Group A material. Compound 2 comprises a mixture of Component Group B and D materials wherein the weight of Component Group B materials does not exceed the weight of the Component Group A materials in Compound 1 and wherein the Component Group D materials comprise between 0.5 and 7.5% by weight of the Component Group B materials in the same Compound 2. Clearly a wide range of compositions for Compound 1 and Compound 2 are possible as long as the following guidelines are followed wherein a given Compound 1 is matched in composition to a given Compound 2.

Component Group A comprises an elastomer portion of the matrix. A number of isoprenoid containing rubber-type compounds can act as Component Group A materials. The favored material is a semi-synthetic vulcanized and chlorinated polymer. That is, the carbon atoms making up the polymer chain bear covalently bonded sulfur and chlorine atoms. Other halogen substituents are also applicable. Commercially available compounds of this class include butyl rubber, and polymers available under the brand names of NEOPRENE®, THIOKOL®, KRATON®, and CHLOROPREN®, among others. Additional similar rubber-like polymers also usable as members of Component Group A are well-know to those of ordinary skill in the art. The NRC materials produced to date generally contain only a single Compound group A material, but there is no reason that a blend of several of these materials cannot be used to attain particular properties. For example, use of several more highly halogenated materials increases the overall resistance to certain chemicals, organic solvents in particular. An application in which the NRC is liable to be exposed to organic solvents can benefit from use of more heavily halogenated Component group A materials.

Component Group B materials comprise any of a number of polymide or polyimide resins containing polymers imide linkages of the general structure CO—NR—CO wherein "C" denotes a carbon atom, "O" denotes an oxygen atom, "N" denotes a nitrogen atom and "R" denotes an organic radical. The possibilities for "R" is almost endless, but readily obtainable polyimide resins employ R groups such as methyl-2-pyrrolidone. Available resins that are Component Group B materials include materials sold under the brand names of P-84® and ENVEX.® In addition, some or all of the Component Group B material may comprise a vinylpolydimethyl resin.

Component Group C materials are added primarily to increase the nuclear radiation shielding and resistance of the NRC. Many Component Group C materials are barium compounds and/or compounds of elements in the same group of the periodic table as barium. For both non-nuclear and nuclear applications, one or more of the following powders, which should be of a mean particle size of no more than approximately 10 $\mu$m in diameter and preferably less than approximately 5 $\mu$m in diameter, are useful: aluminum oxide (approximately 5–15% by weight of the Component Group A material employed in the particular Compound 1 and preferably approximately 10% by weight); barium compounds (up to approximately 35% maximum by weight) such as barium sulfate ($BaSO_4$), barium carbonate ($BaCO_3$), barium ferrite ($BaFe_{12}O_{19}$), barium nitrate ($Ba(NO_3)_2$), barium metaborate ($BaB_2O_4.H_2O$), barium oxide (BaO), barium silicate ($BaSiO_3$), barium zirconate ($BaZrO_3$), barium acrylate, barium methacrylate, barium alkoxide, barium isopropoxide, and/or barium ironisopropoxide; lead compounds (up to approximately 35% maximum by weight of the Component Group A material) such as lead (II) carbonate ($(PbCO_3)_2.Pb(OH)_2$), lead (II) chromate ($PbCrO_4$), lead molybdenum oxide ($PbMoO_4$), lead (II) nitrate ($Pb(NO_3])_2$), lead orthophosphate ($Pb_3(PO_4)_2$), lead (II) oxide (PbO), lead (II, III) oxide ($Pb_3O_4$), lead (II) stearate ($Pb(C_{18}H_{35}O_2)_2$), lead acrylate, and/or lead methacrylate. Particularly for nuclear applications, powders of tungsten carbide, titanium carbide, lead oxide, heavy metal compounds, and iodine-including iodides and organoiodine compounds—may also be added, but the total weight of these five additional materials preferably should not exceed more than approximately 10% of the weight the of the Component Group A material. Moreover, the total amount of all of the preceding listed powders should comprise approximately 7.5–17.5% by weight of the Component Group A material; for nuclear applications the total amount of all of the preceding Component Group C materials preferably is approximately 12.5–17.5% by weight of the Component Group A material.

Component Group D materials consist of two different subgroups. Componen Group D polymeric materials provide the thermosetting properties to the NRC. These materials are intended to react with and cross-link the Component Group A and B materials. The "archetypal" Component Group D polymeric material is a phenol-formaldehyde resin (up to approximately 5% by weight of the Component Group B material). A wide range of phenol-formaldehyde resins are available and useful in the present invention. In addition, formaldehyde (preferably as paraformaldehyde) can be added directly. In such a case phenolic resins can favorably be added in place of the phenol-formaldehyde resin (that material being formed in situ). Alternatively, additional radiation resistance can be obtained by substituting platinumvinyl polymer (organoplatinum) for the polyformaldehyde compounds. Either phenol-formaldehyde and/or platinumvinyl polymers are essential parts to the NRC composition. Some of the other materials which may be used as Component Group D additive materials. Such additives to the polyformaldehyde or platinumvinyl include fume silica gel and gum acacia (which acts as a binder). Component Group D additive materials can also include: magnesium oxide (approximately 1–8% and preferably approximately 3% by weight of the total of Component Group D materials); zirconium oxide (approximately 1–5% and preferably approximately 2% of the total of Component Group D materials); silicon dioxide (approximately 1–10% and preferably approximately 5% of the total of Component Group D materials); silicon oxide (approximately 1–5% of the total of Component Group D materials); zirconium silicate (approximately 2–10% and preferably approximately 4% of the total of Component Group D materials); and carbon. In addition iron oxide and/or other iron compounds such as iron phosphate ($FePO_2$), iron silicide (FeSi), and/or iron (III) sulfate ($Fe_2(SO_4)_3$) can be used but should represent no more than 2% of the total weight of the Component Group D material. Zirconium oxide, zirconium silicate, and iron oxide preferably are used for only nuclear applications. Titanium oxide (up to approximately 1% maximum of the weight of Component Group D materials) and beryllium oxide (up to approximately 1% maximum of the weight of Component Group D materials) may also be used. Although NRC made without additives to the formaldehyde resin, the resulting NRC is generally less effective than NRC made with formaldehyde resin. Nevertheless, the inventor contemplates making NRC without additives to the formaldehyde resin.

While the Component Group C materials described in the preceding paragraphs are the preferred ingredients of NRC, some of them can be omitted and that the total weight of the Component Group C materials used can be less than 7.5% by weight of the Component Group A materials. For example, the inventor contemplates using only aluminum oxide, and formaldehyde to create NRC designed to reduce weight and increase thermal conductivity. In addition, the barium compounds listed above, the lead compounds listed above, iron phosphate, iron silicide and/or iron sulfate can also be used for reduction of nucleation.

NRC made with iron oxide, titanium oxide, zirconium silicate, zirconium oxide, and beryllium oxide may be used in all applications, but preferably is used in nuclear contaminated areas. NRC containing free carbon preferably is not used in nuclear applications because of the fire hazard especially in the presence of free oxygen. Nevertheless, NRC made with free carbon may be used in non-nuclear applications because it is light and inexpensive; it also acts as a fire retardant, although carbon monoxide results when the NRC containing free carbon is burned.

NRC is created by mixing together two basic Compounds "1" and "2" comprised of Component Group A, B, C, and D materials, where material B is a polyimide or polyimide resin (equal to up to 100% by weight of material A). Compound 2 comprising various combinations of phenolic/thermosetting and/or platinumovinyl polymer. NRC is created by mixing and heating Components 1 and 2 together.

Compound 1=[Component Group A material+Component Group C material (7.5–17.5% by weight of A)]

Compound 2=[Component Group B material (not to exceed weight of Component Group A material)+Component Group D material (0.5–7.5% by weight of Component Group B material)]

NRC=Component 1+Component 2

Compound 1 is comprised of Component Group A material premixed with Component Group C material such that material C is 7.5–17.5% by weight of the material A. Compound 2 is comprised of Component Group B material premixed with Component Group D material, such that material D is 1–15% by weight of Material B. Alternatively, Compound 2 may be made by mixing together platinumovinyl polymer (approximately 1–15% by weight of Compound 2) instead of the polyformaldehyde, into Component Group B material. The two premixed compounds are then mixed together, such that the original weights of material A and material B prior to premixing are preferably equal to one another.

The inventor also contemplates Component Group B material can comprise a platinum phenilil resin, and/or a platinum vinyl resin. Using a platinum phenolic resin for Component Group B material will produce a denser version of NRC. The denser version is preferable for nuclear environment applications, while the less dense version of NRC is preferable for non-nuclear environment applications.

Mixing together of the two compounds should preferably take place in a high pressure (at least approximately 2400 p.s.i.) static mixer. Alternatively, the mixing may be done by hand, or with a standard mixer, or with an ultrasonic mixer, or with a static mixer attached to an ultrasound device. Nevertheless, an ultrasonic mixer is more practical. Compound 1 is ejected through one rotating nozzle of the ultrasonic mixer, and Compound 2 is ejected through another rotating nozzle. The two Compounds combine in midair inside the cube-like head at the end of the mixer, and resulting the mixture is injected into a mold, preferably made of aluminum, or sprayed on a surface, where the resulting NRC begins to cure and polymerize. For nuclear applications, the NRC should formulated with an increase in weight/volume of approximately 30–60% and preferably by approximately 50% as compared to non-nuclear applications. The mixed NRC is then cured at an elevated temperature (approx. 260° C. for about 45 minutes). In addition, if Compound 1 is heated to 120° C. just prior to being mixed with Compound 2, the resulting NRC can cure in only about 25 minutes. NRC has a density ranging from approximately 8 to 50 pounds per cubic foot and when cured at an elevated temperature and pressure has an extremely hard, solid structure with a 20,000 p.s.i. shear strength.

Figure 2:
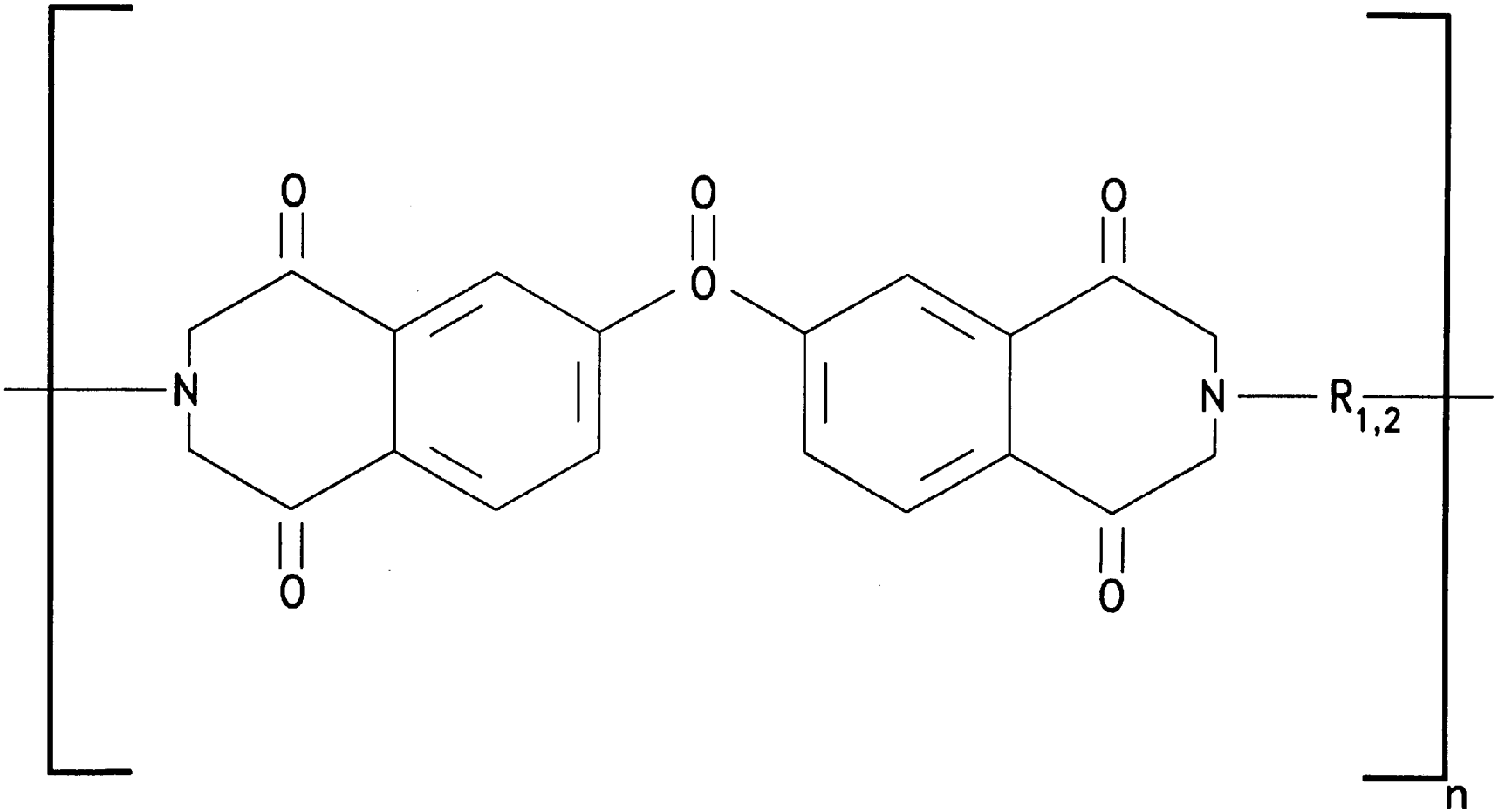
FIG. 2 a chemical diagram of the imidized and aromatic polyimide which is believed to comprise the polymeric backbone of the material of the present invention.

FIG. 1 represents a diagrammatic representation of the interaction of the various Component Group materials in cured NRC. The elastomer Component Group A material links to the binder phenol-formaldehyde resin of Component Group D material and this linkage includes the various binder/additives of Component Group D. At the same time both Component Group A and Component Group D materials are crosslinked to the imide polymers of Component Group B material. This entire crosslinked structure also includes the nucleation blockers of Component Group C. It is believed that the primary backbone polymeric structure formed by thermal curing is an imidized and aromatic shown in FIG. 2 with R being, in a preferred composition, methyl-2-pyrrolidone. The ceramometallic properties are provided by the various additives and tend to strengthen and predominate when and if the material is subjected to extremely high temperatures.

In addition to the equivalents of the claimed elements, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope and spirit of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. A shielding system for resisting nuclear radiation comprising:

a source of nuclear radiation; and a nuclear radiation resisting member disposed about the source of nuclear radiation, said member comprising a heat-cured mixture of a first composition and a second composition, wherein the first composition comprises a mixture of group A materials and group C materials so that the group C materials comprise 5–20% by weight of the group A materials wherein the group A materials comprise isoprenoid-containing elastomeric compounds and wherein group C materials comprise nuclear radiation shielding compounds;

wherein the second composition comprises a mixture of group B materials and group D polymeric materials so that the group D materials comprise 0.5–10% by weight of the group B materials wherein the group B materials comprise at least one of polyimide resin, platinum phenolic resin and platinum vinyl resin and do not exceed the weight of the group A materials in the first composition; and wherein the group D materials comprise phenol-formaldehyde resin.

2. The shielding system of claim 1, wherein the group C materials are selected from the list consisting of barium sulfate, barium carbonate, barium ferrite, barium nitrate, barium metaborate, barium oxide, barium silicate, barium zirconate, barium acrylate, barium alkoxide, barium isopropoxide, barium ironisopropoxide, lead carbonate, lead chromate, lead molybdenum oxide, lead nitrate, lead orthophosphate, lead oxide, lead stearate, lead acrylate, lead methacrylate, tungsten carbide, titanium carbide, and iodine.

3. The shielding system of claim 1, wherein the group D polymeric materials further comprise platinum vinyl polymer.

4. The shielding system of claim 1, wherein the group D polymeric materials further comprise group D additives which are selected from the group consisting of fume silica gel, gum acacia, magnesium oxide, zirconium oxide, silicon dioxide, silicon oxide, zirconium silicate, carbon, iron oxide, iron phosphate, iron silicide, iron sulfate, titanium oxide, and beryllium oxide.

5. The shielding system of claim 1, wherein weights of the first composition and the second composition are selected so that a weight of the group A materials in the first composition is equal to a weight of the group B materials in the second composition.

6. The shielding system of claim 1, wherein the group B materials comprise platinum phenolic resin and/or platinum vinyl resin.

7. A nuclear radiation resistant thermosetting composition comprising:

a heat-cured mixture of a first composition and a second composition, wherein the first composition comprises a mixture of group A materials and group C materials so that the group C materials comprise 5–20% by weight of the group A materials wherein the group A materials comprise isoprenoid-containing elastomeric compounds and wherein group C materials comprise nuclear radiation shielding compounds; and wherein the second composition comprises a mixture of group B materials and group D polymeric materials so that the group D materials comprise 0.5–10% by weight of the group B materials wherein the group B materials comprise at least one of polyimide resin, platinum phenolic resin and platinum vinyl resin and do not exceed the weight of the group A materials in the first composition; and wherein the group D materials comprise phenol-formaldehyde resin and platinum vinyl polymer.

8. A nuclear radiation resistant thermosetting composition comprising:

a heat-cured mixture of a first composition and a second composition, wherein the first composition comprises a mixture of group A materials and group C materials so that the group C materials comprise 5–20% by weight of the group A materials wherein the group A materials comprise isoprenoid-containing elastomeric compounds and wherein group C materials comprise nuclear radiation shielding compounds; and wherein the second composition comprises a mixture of group B materials and group D polymeric materials so that the group D materials comprise 0.5–10% by weight of the group B materials wherein the group B materials comprise platinum phenolic resin and/or platinum vinyl resin and do not exceed the weight of the group A materials in the first composition; and wherein the group D materials comprise phenol-formaldehyde resin.

* * * * *